US006801732B2

(12) United States Patent
Choi et al.

(10) Patent No.: US 6,801,732 B2
(45) Date of Patent: Oct. 5, 2004

(54) DEVELOPING APPARATUS OF ELECTRIC PHOTOGRAPHIC PRINTER

(75) Inventors: Jeong-jai Choi, Suwon (KR); Chung-guk Baek, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/284,087

(22) Filed: Oct. 31, 2002

(65) Prior Publication Data

US 2003/0099482 A1 May 29, 2003

(30) Foreign Application Priority Data

Nov. 27, 2001 (KR) ..... 2001-74157

(51) Int. Cl.[7] ..... G03G 15/08; G03G 15/09
(52) U.S. Cl. ..... 399/104; 399/267; 399/277
(58) Field of Search ..... 399/104, 98, 102, 399/277, 267

(56) References Cited

U.S. PATENT DOCUMENTS

| | | | | |
|---|---|---|---|---|
| 3,906,899 | A | * 9/1975 | Harpavat | 399/104 |
| 4,774,543 | A | * 9/1988 | Yoshikawa et al. | 399/267 X |
| 5,065,693 | A | * 11/1991 | Yoshino et al. | 399/104 |
| 5,267,007 | A | * 11/1993 | Watanabe et al. | 399/104 |
| 6,324,372 | B1 | * 11/2001 | Hirota | 399/277 |
| 6,336,013 | B1 | * 1/2002 | Suda et al. | 399/104 X |

FOREIGN PATENT DOCUMENTS

| | | | |
|---|---|---|---|
| EP | 0 390 472 A2 | * | 10/1990 |
| JP | 02-304584 | * | 12/1990 |
| JP | 03-004265 | * | 1/1991 |
| JP | 03-013977 | * | 1/1991 |
| JP | 04-016878 | * | 1/1992 |
| JP | 05-011618 | * | 1/1993 |
| JP | 2000-147905 | * | 5/2000 |
| JP | 2000-162869 | * | 6/2000 |

* cited by examiner

*Primary Examiner*—Sophia S. Chen
(74) *Attorney, Agent, or Firm*—Staas & Halsey LLP

(57) ABSTRACT

A developing apparatus of an electric photographic printer supplying a two-element developing agent to develop an electrostatic latent image formed on a photosensitive medium includes: a housing; a developing agent supplying roller; a developing agent mixing roller; a developing sleeve to transfer mixed developing agent to the photosensitive medium through a developing area formed between the developing sleeve and the photosensitive medium; a fixing magnet disposed inside of the developing sleeve to have a plurality of magnetic poles arranged from the developing area in a circular direction about a center of the fixing magnet; and a magnetic bar disposed on an inside surface of the housing to face one of the magnetic poles of the fixing magnet through the developing sleeve to form a magnetic force brush preventing the developing agent from being scattered as the developing agent passes through the developing area.

35 Claims, 4 Drawing Sheets

DEVELOPING APPARATUS OF ELECTRIC PHOTOGRAPHIC PRINTER

CROSS-REFERENCE TO RELATED APPLICATIONS

This application claims the benefit of Korean Patent Application No. 2001-74157, filed Nov. 27, 2001, in the Korean Industrial Property Office, the disclosure of which is incorporated herein by reference.

BACKGROUND OF THE INVENTION

1. Field of the Invention

The present invention relates to a developing apparatus of an electric photographic printer, and more particularly, to a developing apparatus of an electric photographic printer capable of preventing a developing agent from being scattered in a developing area.

2. Description of the Related Art

An electric photographic printer is an apparatus to print an image by transferring an electrostatic latent image formed at a photosensitive medium to a printing medium after developing the electrostatic latent image to a visible image using a developing agent. In this case, the developing agent is normally a magnetic one-element developing agent or a nonmagnetic two-element developing agent.

The two-element developing agent includes toner and a carrier mixed at a predetermined rate. The carrier adheres as a brush shape to a surface of a developing roller by a magnetic force of the developing roller, and the toner adheres to the carrier by an electrostatic force.

FIG. 1 is a sectional view schematically showing a structure of a developing apparatus 10 of the electric photographic printer using the two-element developing agent.

Referring to FIG. 1, the developing apparatus 10 includes a developing roller 13, a developing agent mixing roller 17, a developing agent supplying roller 18, a magnetic bar 19 and a housing 11.

The developing roller 13 includes a developing sleeve 14 and a fixing magnet 15. The developing sleeve 14 is a hollow cylindrical shape and rotatably installed at the housing 11. The developing roller 13 transfers a developing agent 1 to a developing area A facing a photosensitive medium 20 disposed at opposite to the developing roller 13 with respect to the developing area A. The fixing magnet 15 is installed inside the developing sleeve 14 and is a cylindrical shape having a plurality of fragments. The fixing magnetic 15 has a magnetic pole N1 disposed to face the developing area A, and magnetic poles, S1, N2, N3, and S2 disposed in a counterclockwise in order from the magnetic pole N1 with respect to a center of the developing roller 13. Moreover, a developing blade 16 is disposed in a predetermined space at one upper side of the developing sleeve 14, thus a thickness of the developing agent attached to the developing sleeve 14 can be adjusted to be thinner by a predetermined degree.

The developing agent mixing roller 17 is installed at a rear of the developing sleeve 14. The developing agent mixing roller 17 mixes two elements, such as the toner and the carrier, and allows the developing agent 1 to be electrically charged to have an electrostatic force.

The developing agent supplying roller 18 is disposed at a rear portion of the developing agent mixing roller 17 and supplies the developing agent 1 to the developing agent mixing roller 17.

The housing 11 has the developing sleeve 14, the developing agent mixing roller 17, and the developing agent supplying roller 18. An area of the developing sleeve 11*a* faces the photosensitive medium 20 through an housing opening portion 11*a* of the housing 11.

The magnetic bar 19 is disposed at an outside of upper and lower ends of the hosing open portion 11*a* and adsorbs the developing agent 1 scattered at the developing area A.

An operation of the developing apparatus 10 having the above structure will be described hereinbelow.

The developing agent 1 in the housing 11 is supplied to the developing agent mixing roller 17 by the developing agent supplying roller 18, and thus the toner and the carrier are mixed. The mixed developing agent 1 adheres to the developing sleeve 14 by a magnetic force of the fixing magnet 15 installed inside the developing sleeve 14 and forms a magnetic brush shape. When the developing sleeve 14 is rotated, the developing agent 1 attached to a portion of the developing sleeve 14 passes through the developing agent blade 16 and becomes thinner to a predetermined thickness.

When the portion of the developing sleeve 14 rotates continuously and is disposed at the developing area A, the developing agent 1, which has become thinner, moves to the photosensitive medium 20 by an operation of an electrostatic force of the electrostatic latent image of the photosensitive medium 20.

At this time, when the developing agent 1 has little electrostatic force due to an insufficient electric charge, the developing agent 1 is scattered. Yet, the scattered developing agent 1 adheres to the magnetic bar 19 disposed at an outside portion of upper and lower ends of the hosing open portion 11*a* of the developing apparatus 10 and is prevented from being discharged to the outside portion of the developing apparatus 10.

However, in the developing apparatus 10 described so far, since the magnetic bar 19 is disposed at the outside portion of the housing open portion 11*a*, the developing agent leaking out to the outside portion of the housing 11 of the developing apparatus 10 is adsorbed to the magnetic bar 19. Therefore, a problem occurs that the developing agent 1 scattered at the developing area A cannot be completely prevented from leaking out to the outside portion of the housing 11.

SUMMARY OF THE INVENTION

The present invention has been made to overcome the above and other problems of the prior art. Accordingly, it is the object of the present invention to provide a developing apparatus of an electric photographic printer capable of effectively preventing a developing agent scattered in the developing area from leaking out to an outside portion of the developing apparatus by forming a magnetic force brush between a developing roller and a magnetic bar disposed on an inside portion of the housing.

Additional objects and advantageous of the invention will be set forth in part in the description which follows and, in part, will be obvious from the description, or may be learned by practice of the invention.

In order to achieve the above and other objects, a developing apparatus of an electric photographic printer to supply a two-element developing agent to develop an electrostatic latent image formed on a photosensitive medium includes a housing, a developing agent supplying roller disposed at a lower part of the housing to transfer the developing agent, a developing agent mixing roller disposed at one side of the developing agent supplying roller to mix the developing agent so that two elements of the developing agent can be mixed equally, a developing sleeve rotatably disposed at one upper part of the developing agent mixing roller to transfer the mixed developing agent to a developing area facing the photosensitive medium by rotating in a counterclockwise direction, a fixing magnet disposed inside the developing sleeve to have magnetic poles N1, S1, N2, N3, and S2 arranged from the developing area in the counterclockwise direction with respect to a center of the developing roller to allow the developing agent attached to the developing sleeve to be transferred to the developing area, and a magnetic bar disposed inside the housing to face the magnetic pole S1 of the fixing magnet through the developing sleeve, to form a magnetic force brush preventing the developing agent from being scattered as the developing agent passes through the developing area.

It is possible that the fixing magnet has the magnetic pole N1 disposed to face the photosensitive medium, and a sectional rotation sleeve area of the magnetic pole S1 is almost equal to a total sectional rotation sleeve area of the magnetic poles S2, N3 and N2.

In addition, the magnetic bar includes a magnetic pole with a magnetic polarity, which is opposite to that of the magnetic pole S1 of the fixing magnet, and the magnetic pole of the magnetic bar is disposed to face the fixing magnet. The magnetic bar is a rubber magnet.

Furthermore, the magnetic bar has magnetic force adjustment plates disposed at front and rear ends of the magnetic bar, respectively, and an installation position of the magnetic bar is determined by using a magnetic force distribution by the fixing magnet.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
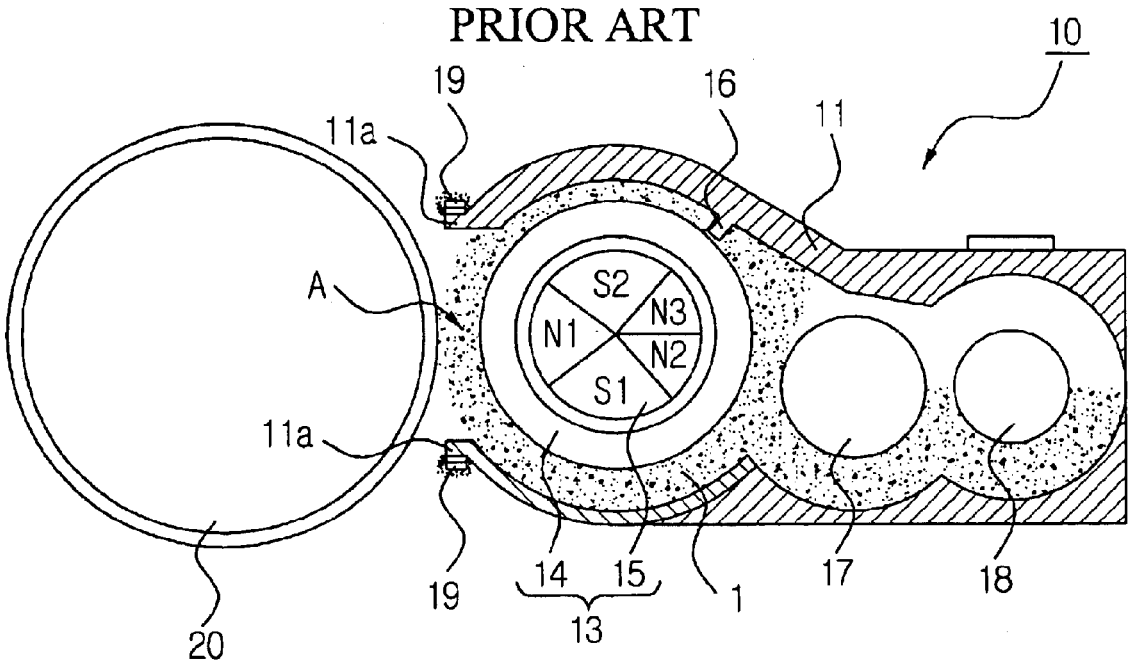
FIG. 1 PRIOR ART
FIG. 1 is a section view schematically showing a structure of a conventional developing apparatus of an electric photographic printer.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinbelow, the present invention will be described in greater detail by referring to the appended drawings.

Figure 2:
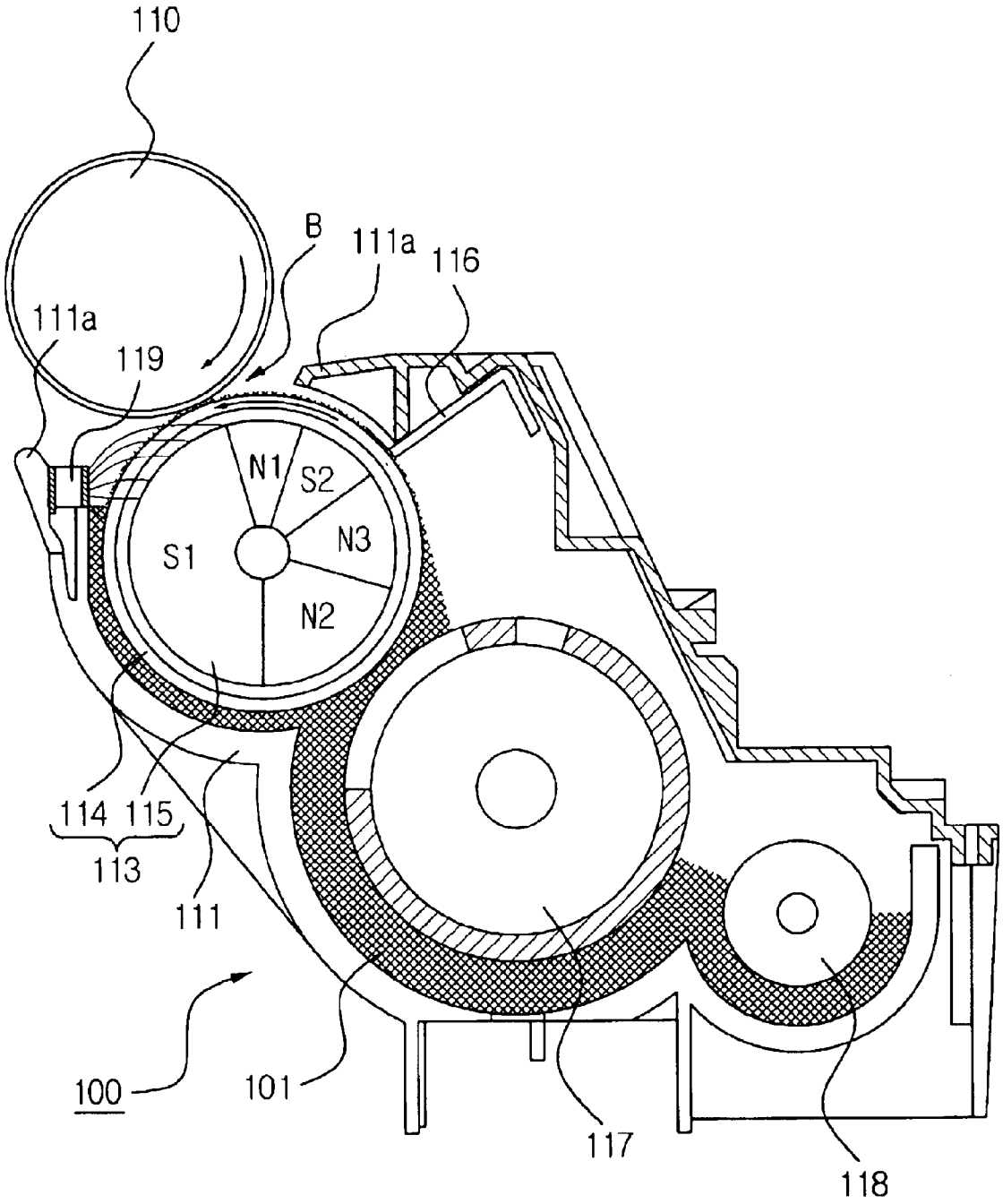
FIG. 2 is a section view schematically showing a structure of a developing apparatus of an electric photographic printer according to an embodiment of the present invention.

Referring to FIG. 2, a developing apparatus 100 includes a developing roller 113, a developing agent mixing roller 117, a developing agent supplying roller 118, a magnetic bar 119 and a housing 111.

The developing roller 113 includes a developing sleeve 114 and a fixing magnet 115. The developing sleeve 114 is a hollow cylindrical type and rotatably disposed in the housing 111, and transfers a developing agent 101 to a developing area B facing a photosensitive medium 110 disposed opposite to the developing sleeve 114 with respect to the developing area B.

The fixing magnet 115 is installed inside the developing sleeve 114, and a shape of the fixing magnet 115 is a hollow cylindrical type drum having a plurality of fragments divided in a circular direction of the hollow cylindrical type drum. The fixing magnetic 115 has a magnetic pole N1 disposed to face the developing area B, and magnetic poles, S1, N2, N3, and S2 disposed in a counterclockwise direction, for example, the circular direction of a center of the fixing magnet 115 from the magnetic pole N1, in order.

The magnetic pole N1 has a magnitude corresponding to the developing area B, and moves the developing agent 101, which has adhered to an outer circumference of the developing sleeve 114 as a form of a brush, to an electrostatic latent image formed on the photosensitive medium 110.

The magnetic pole S1 is disposed at a place in the counterclockwise direction from the magnetic pole N1 with respect to the circular direction, and one side of the magnetic pole S1 is disposed adjacent to the magnetic pole N1 and the other side of the magnetic pole S1 is disposed adjacent to the magnetic pole N2, and a boundary between the magnetic poles S1 and N1 is disposed adjacent to a vertical line that divides the developing sleeve 114 in half. In other words, a sectional area of the magnetic pole S1 is almost equal to a total area of the magnetic poles S2, N3 and N2 in cross section perpendicular to an axial direction of the developing sleeve 114. The magnetic pole S1 transfers the developing agent remaining on the developing sleeve 114 after being used to develop the electrostatic latent image, to an inside of the housing 111.

The magnetic poles N2, N3 and S2 are disposed between the magnetic poles S1 and N1 and consecutively arranged from the magnetic pole S1 in the counterclockwise direction with respect to the circular direction of the developing sleeve 114. An entire area of the magnetic poles N2, N3, and S2 is almost the same as that of the magnetic pole S1 in cross-section perpendicular to the axial direction of the developing sleeve 114. The developing agent, which has remained at the outer circumference of the developing sleeve 114 after developing the electrostatic latent image, is separated from the developing sleeve 114 by the magnetic pole N2. The magnetic pole N3 allows a new developing agent 101 mixed by the developing agent mixing roller 117 to be adsorbed to the developing sleeve 114 and transfers the new developing agent 101 to a developing area B.

In other words, the developing roller 113 is disposed at a considerably higher position than the developing agent mixing roller 117, thus magnetic pole N2 is disposed to slant downwardly with respect to a gravity direction of the developing agent 101 to separate the developing agent 101 from the developing roller 113. The gravity direction represents a direction in which the developing agent 101 falls downwardly by a self-weight. Therefore, an entire area of the magnetic pole S1 in the fixing magnet 115 is larger than that of other magnetic poles N2, N3, S2, and N1.

In addition, a developing agent blade 116 is disposed to be spaced-apart by a predetermined interval from one upper side of the developing sleeve 114, and a boundary of the magnetic pole S2 and the magnetic pole N3 is disposed adjacent to the developing agent blade 116. The developing agent blade 116 makes the developing agent 101 adhering to the developing sleeve 114 thin to a predetermined thickness.

The developing agent mixing roller 117 is disposed at a lower rear side of the developing sleeve 114 and mixes two elements of the developing agent 101, such as toner and a carrier. Besides, the developing agent mixing roller 117 allows the developing agent 101 to have an electrostatic force by being electrically charged by a friction between the developing agent 101 and the developing agent mixing roller 117.

The developing agent supplying roller 118 is disposed at a rear side of the developing agent mixing roller 117 and supplies the developing agent 101 to the developing agent mixing roller 117. The photosensitive medium 110, the developing sleeve 113, the developing agent mixing roller 117, and the developing agent supplying roller 118 are arranged downwardly in a cascade fashion.

The housing 111 supports and wraps the developing roller 113, the developing agent mixing roller 117, and the developing agent supplying roller 118, thus the developing agent stored inside thereof does not leak out to an outside of the housing 111 of the developing apparatus 100. A part of the housing 111 is open above an upper portion 111a of the developing sleeve 114 facing the photosensitive medium 110.

Figure 4:
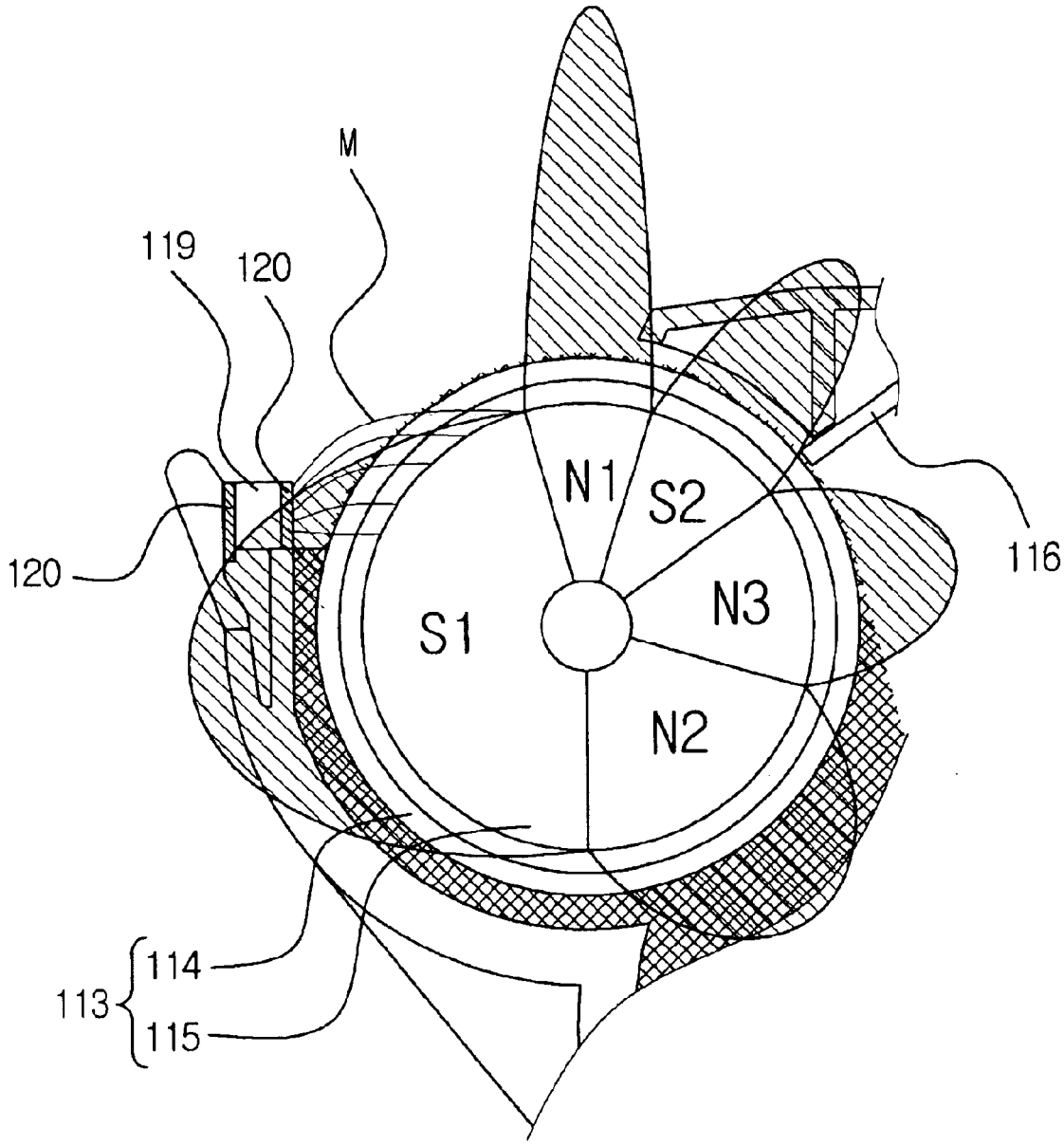
FIG. 4 is a partial section view showing a magnetic distribution of a fixing magnet and attached to the developing sleeve by a magnetic force brush of the magnetic bar of FIG. 2.

The magnetic bar 119 is installed on an inside of the housing open portion 111*a*, which is disposed in a direction that when the developing sleeve 114 rotates, a surface of the developing sleeve 114 enters the housing 111 after passing through the developing area B, and adsorbs the developing agent scattered at the developing area B. In other words, the magnetic bar 119 is disposed on an inner surface of the inside of the housing 100 adjacent to the housing open portion 111*a* to face the magnetic pole S1 of the fixing magnet 115 through the developing sleeve 114. The space between the magnetic bar 119 and the developing sleeve 114 may be less than 10 mm. As shown in FIG. 4, a magnetic force brush M is made by lines of a magnetic force generated between the magnetic bar 119 and the magnetic pole S1. Therefore, it is possible that the magnetic bar 119 is disposed opposite to the magnetic poles N1, N2. N3, or S2 with respect to the magnetic pole S1.

Furthermore, it is possible that the magnetic bar 119 is made of a rubber magnet to easily adjust the magnetic force. It is recommended that the magnetic force of the magnetic bar 119 is a half of the magnetic force of the magnetic pole S1 of the fixing magnet 115. Two plates 120 can be disposed at respective ones of front and rear sides of the magnetic bar made of the rubber magnet to adjust the magnetic force as shown in FIG. 4, and it is possible that the plates 120 are made of iron.

Hereinbelow, an operation of the developing apparatus 100 having the above structure will be described.

The developing agent mixing roller 117 mixes the developing agent 101 supplied by the developing agent supplying roller 118 with the developing agent 101 remaining on the developing sleeve 114 after the electrostatic latent image is developed so that the toner and the carrier can be evenly mixed at a predetermined rate. The mixed developing agent 101 adheres to the outer circumference of the developing sleeve 114 by the magnetic pole N3 of the fixing magnet 115 and is transferred to the developing area B after becoming thinner to the predetermined thickness by the developing blade 116 as the developing sleeve 114 continuously rotates. The developing agent 101 transferred to the developing area B moves to the photosensitive medium 110 by an electrostatic force of the electrostatic latent image and the magnetic pole N1 of the fixing magnet 115, and develops the electrostatic latent image.

Figure 3:
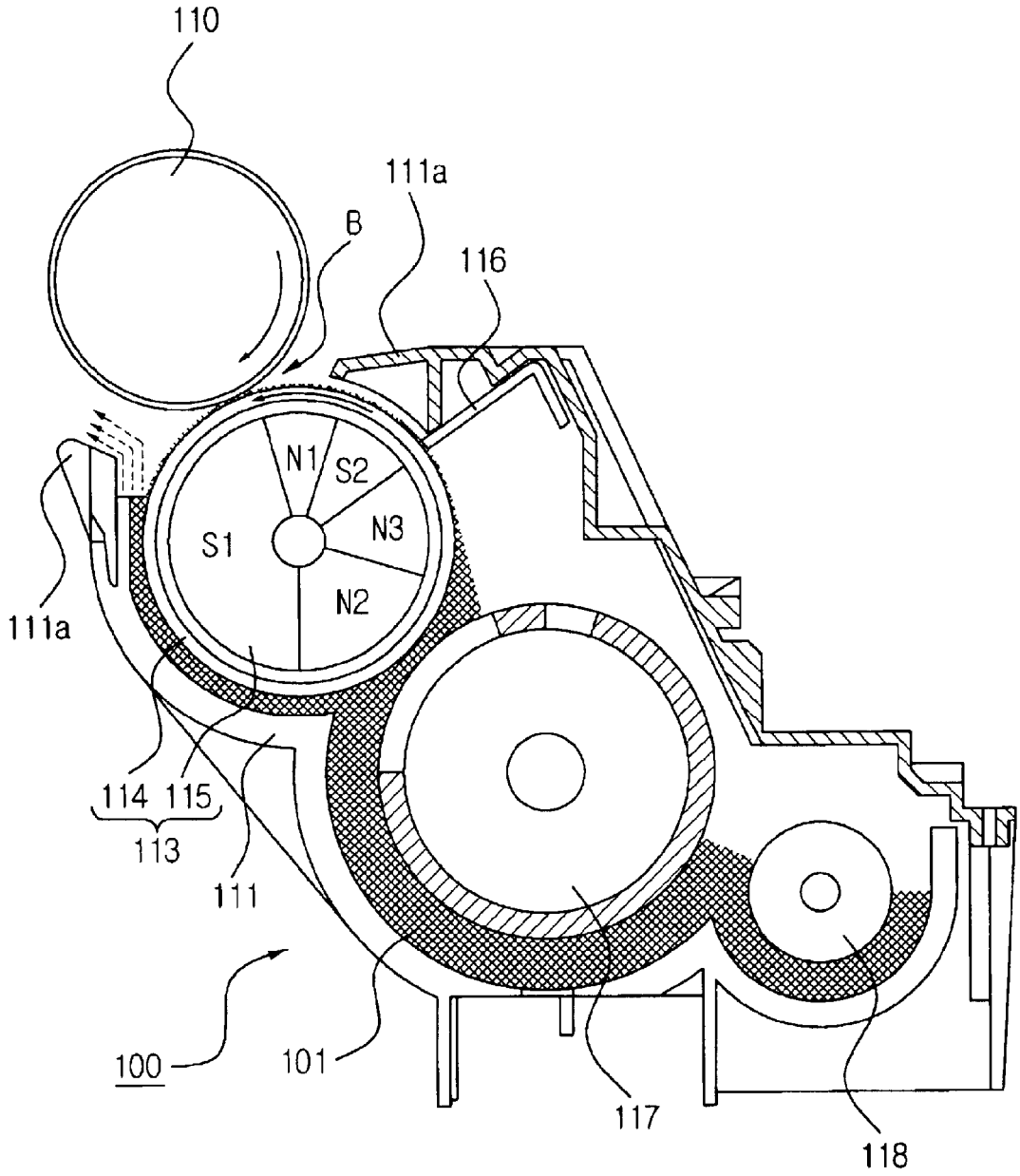
FIG. 3 is a view showing a status of a scattered developing agent when the magnetic bar is removed from the developing apparatus of FIG. 2.

The developing agent remaining on the developing sleeve 114 after developing the electrostatic latent image is recollected into the housing 111 as the developing sleeve 114 rotates. However, as shown in FIG. 3, some portion of the remaining developing agent 101 tends to be discharged to the outside of the housing 111 by colliding with the housing open portion 111*a* of the housing 111 due to a centrifugal force by a rotation of the developing sleeve 114.

However, as shown in FIG. 4 the discharged developing agent adheres to the magnetic bar 119 by the magnetic force brush M formed between the magnetic bar 119 disposed inside the housing open portion 111*a* of the housing 111 and the magnetic pole S1 of the fixing magnet 115. Moreover, the magnetic force brush M is inclined in a rotation direction of the developing sleeve 114 by the rotation of the developing sleeve 114, and the developing agent 101 disposed in the magnetic force brush M is transferred downwardly after colliding with new developing agent transferred by the rotation of the developing sleeve 114. In other words, the absorbed developing agent 101 no longer remains due to the magnetic force brush M of the magnetic bar 119, is replaced by new developing agent 101, and is returned to the inside of the housing 111. Therefore, the developing agent 101 is not scattered and at the same time the developing agent 101 does not lose an electrical charge characteristic.

Moreover, the developing agent 101 falling to be scattered due to lack of the electrostatic force at the developing area B adheres to the magnetic bar 119 by an electrostatic force of the developing agent 101 and the magnetic force brush M of the magnetic bar 119 and is not scattered to the outside of the housing 111 of the developing apparatus 100. In addition, the developing agent 101 scattered upwardly by colliding with a side wall of the housing 111 after passing through the magnetic force brush M of the magnetic bar 119 does not flow to the outside of the housing 111 as the developing agent 101 is blocked by the magnetic force brush M.

The remaining developing agent 101 collected by the above operation is mixed with the new developing agent 101 again and supplied to the developing sleeve 114 so that the electrostatic latent image is continuously developed.

According to the developing apparatus 100 having the above structure, as the magnetic bar 119 installed inside of the housing 111 adsorbs the developing agent 101 before the developing agent 101 flows to the outside of the housing 111 of the developing apparatus 100, the developing agent 101 can be effectively prevented from being scattered.

Furthermore, the scattered developing agent 101 can be used, as the developing agent 101 disposed in the lines of magnetic force, i.e., the magnetic force brush M, formed by the magnetic bar 119, is separated from the lines by the new developing agent 101. The separated developing agent 101 is attracted and moved into the housing 111.

As described so far, according to the developing apparatus of an electric photographic printer, developing agent can be effectively prevented from being scattered as the magnetic bar is disposed on the inner surface of the housing of the developing apparatus forming the magnetic brush between the fixing magnetic and itself for preventing scattering, and the developing agent is attracted to the magnetic brush before being scattered.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A developing apparatus of an electric photographic printer supplying a two-element developing agent to develop an electrostatic latent image formed on a photosensitive medium, comprising:

a housing;

a developing agent supplying roller disposed at a lower part of the housing to transfer the developing agent;

a developing agent mixing roller disposed at one side of the developing agent supplying roller to mix the developing agent so that two elements of the developing agent are mixable equally;

a developing sleeve rotatably disposed in the housing and at one upper part of the developing agent mixing roller to transfer the mixed developing agent to the photosensitive medium through a developing area formed between the developing sleeve and the photosensitive medium;

a fixing magnet disposed inside of the developing sleeve to have a plurality of magnetic poles arranged from the developing area in a circular direction about a center of the fixing magnet to allow the developing agent to be transferred to the developing area through the developing sleeve; and a magnetic bar disposed on an inside surface of the housing to face one of the magnetic poles of the fixing magnet through the developing sleeve to form a magnetic force brush to absorb the developing agent scattered at the developing area.

2. The developing apparatus of claim 1, wherein the magnetic poles comprises first, second, third, fourth, and fifth magnetic poles (N1, S1, N2, N3, S2) arranged in a circular direction of the fixing magnet from the developing area, and the first magnetic pole (N1) of the fixing magnet is disposed to correspond to the photosensitive medium, and a sectional rotation sleeve area of the second magnetic pole (S1) being almost equal to a total sectional rotation sleeve area of the third, fourth, and fifth magnetic poles (S2, N3 and N2).

3. The developing apparatus of claim 2, wherein the magnetic bar has a sixth magnetic pole with a magnetic polarity, which is opposite to that of the second magnetic pole (S1) of the fixing magnet, and the sixth magnetic pole of the magnetic bar is disposed to face the fixing magnet through the developing sleeve.

4. The developing apparatus of claim 2, wherein a magnetic force of the magnetic bar is determined on a basis of a magnetic force of the second magnetic pole (S1) of the fixing magnet.

5. The developing apparatus of claim 4, wherein the magnetic force of the magnetic bar is a half of the magnetic force of the second magnetic pole (S1) of the fixing magnet.

6. The developing apparatus of claim 1, wherein the magnetic bar is a rubber magnet.

7. The developing apparatus of claim 1, wherein the magnetic bar has a magnetic force adjustment plate disposed on opposite surfaces of the magnetic bar.

8. The developing apparatus of claim 1, wherein an installation position of the magnetic bar is determined by using a magnetic force distribution by the fixing magnet.

9. The developing apparatus of claim 1, wherein an interval between the magnetic bar and the developing sleeve is less than 10 mm.

10. A developing apparatus in an electric photographic printer supplying a developing agent to develop an electrostatic latent image formed on a photosensitive medium, comprising:

a housing containing the developing agent and having an opening portion facing the photosensitive medium;

a developing sleeve rotatably disposed in an inside of the housing to form a developing area with the photosensitive medium and transfer the developing agent to the photosensitive medium through the developing area and the opening portion of the housing;

a fixing magnet disposed in the developing sleeve; and a magnetic bar disposed on an inside surface of the opening portion of the housing to face the developing sleeve to form a magnetic force brush with the fixing magnet to prevent the developing agent remaining on the developing sleeve from being scattering to an outside of the housing after the developing sleeve has developed the electrostatic latent image of the photosensitive medium with the developing agent, therein the magnetic bar disposed so that the magnetic brush force is inclined in a rotation direction of the developer sleeve.

11. The developing apparatus of claim 10, wherein the developing sleeve comprises a first portion facing the photosensitive medium through the opening portion of the housing and a second portion disposed in the housing, and the magnetic bar faces the first portion of the developing sleeve.

12. The developing apparatus of claim 11, wherein the opening portion of the housing comprises a first opening and a second opening in a rotational direction of the developing sleeve, and the magnetic bar is disposed on the inside surface of the second opening of the opening portion of the housing.

13. The developing apparatus of claim 10, wherein the opening portion of the housing comprises first and second ends disposed in a rotation direction of the developing sleeve, and the magnetic bar is disposed on the second end of the opening portion of the housing.

14. The developing apparatus of claim 10, wherein the photosensitive medium and the developing sleeve are disposed in a cascade fashion.

15. The developing apparatus of claim 10, wherein the apparatus comprises:

a developing agent supplying roller disposed at a lowest portion of the housing to transfer the developing agent in an upward direction; and a developing agent mixing roller disposed between the developing sleeve and the developing agent supplying roller to mix toner and a carrier to form the developing agent and transfer the mixed developing agent to the developing sleeve in the upward direction.

16. The developing apparatus of claim 15, wherein the photosensitive medium, the developing sleeve, the developing agent mixing roller, and the developing agent supplying roller are arranged in a cascade fashion, and the developing agent is transferred to the photosensitive medium upwardly through the developing sleeve, the developing agent mixing roller, and the developing agent supplying roller.

17. A developing apparatus in an electric photographic printer supplying a developing agent to develop an electrostatic latent image formed on a photosensitive medium, comprising:

a housing containing the developing agent and having an opening portion facing the photosensitive medium:

a developing sleeve rotatable disposed in an inside of the housing to form a developing area with the photosensitive medium and transfer the developing agent to the photosensitive medium through the developing area and the opening portion of the housing;

a fixing magnet disposed in the developing sleeve; and a magnetic bar disposed on an inside surface of the opening portion of the housing to face the developing sleeve to form a magnetic force brush with the fixing magnet to prevent the developing agent remaining on the developing sleeve from being scattering to an outside of the housing after the developing sleeve has developed the electrostatic latent image of the photosensitive medium with the developing agent, wherein the fixing magnet comprises first, second, third, fourth, and fifth magnetic poles arranged from the opening portion of the housing in a circular direction with respect to a center of the developing sleeve, and the first and second magnetic poles is disposed opposite to each other with respect to a line passing centers of the photosensitive medium and the developing sleeve.

18. The developing apparatus of claim 17, wherein the first, third, and fourth magnetic poles have a polarity opposite to that of the second and fifth magnetic poles.

19. The developing apparatus of claim 17, wherein the second magnetic pole faces the magnetic bar through the magnetic sleeve.

20. The developing apparatus of claim 17, wherein the second magnetic pole has a polarity opposite to that of the magnetic bar.

21. The developing apparatus of claim 17, wherein the third and fourth magnetic poles are in a single body.

22. The developing apparatus of claim 17, wherein the developing sleeve comprises a first portion exposed through the opening portion of the housing and a second portion disposed in the housing, and the first magnetic pole and a portion of the second magnetic pole are disposed to correspond to the first portion of the developing sleeve.

23. The developing apparatus of claim 17, wherein the first and second magnetic poles have an area more than a half of a sum area of the third, fourth, and fifth magnetic poles.

24. The developing apparatus of claim 17, wherein the second magnetic pole has an area greater than a sum area of any combination of the first, third, fourth, and fifth magnetic poles except a total sum of the first, third, fourth, and fifth magnetic poles.

25. The developing apparatus of claim 17, wherein the second magnetic pole is equal to a sum of the third, fourth, and fifth magnetic poles in cross section.

26. The developing apparatus of claim 17, wherein a boundary of the first and second magnetic poles is disposed in the developing area.

27. The developing apparatus of claim 17, wherein the second magnetic pole comprises a first section corresponding to an end portion of the developing area, a second section corresponding to the magnetic force brush formed with the magnetic bar, and a third section corresponding to an inside of the housing.

28. The developing apparatus of claim 17, wherein the fixing magnet comprises a hole formed in a center portion of the developing sleeve and defined by the first, second, third, fourth, and fifth magnetic poles, and the first, second, third, fourth, and fifth magnetic poles are disposed between the hole and the developing sleeve.

29. A developing apparatus in an electric photographic printer supplying a developing agent to develop an electrostatic latent image formed on a photosensitive medium, comprising:

a housing containing the developing agent and having an opening portion facing the photosensitive medium;

a developing sleeve rotatably disposed in the housing to form a developing area with the photosensitive medium and transfer the developing agent to the photosensitive medium through a developing area and the opening portion of the housing, having a first portion exposed through the opening portion of the housing and a second portion disposed in the housing;

a fixing magnet disposed in the developing sleeve and having first, second, third, fourth, fifth magnetic poles arranged in a circular direction with respect to a center of the developing sleeve, the first magnetic pole corresponding to the developing area and a starting portion of the opening portion of the housing to face the photosensitive medium, the second magnetic pole having a first section disposed adjacent to the first magnetic pole, a second section corresponding to an ending portion of the opening portion of the housing to face the photosensitive medium, and a third section disposed in the housing, the third, fourth, and fifth magnetic poles corresponding to an inside of the housing; and a magnetic bar disposed on the opening portion of the housing to form a magnetic force brush with the second magnetic pole of the fixing magnet, and having a polarity opposite to the second magnetic pole, the magnetic force brush absorbing developing agent scattered at the developing area.

30. The developing apparatus of claim 29, wherein a magnetic force of the magnetic bar is equal to or less than that of the second magnetic pole of the fixing magnet.

31. The developing apparatus of claim 29, wherein the magnetic bar is disposed on an inside surface of the opening portion of the housing to face the second magnetic pole through the ending portion of the opening portion of the housing.

32. The developing apparatus of claim 29, wherein the first magnetic pole allows the developing agent to be transferred from the developing sleeve to the photosensitive medium through the developing area and the starting portion of the opening portion of the housing, the second section of the second magnetic pole forms the magnetic force brush with the magnetic bar, the third magnetic pole separating the developing agent remaining on the magnetic sleeve from the magnetic sleeve, and the fourth magnetic pole allows the developing agent to be adsorbed to the developing sleeve corresponding to the fourth magnetic pole.

33. The developing apparatus of claim 29, wherein the first, third, and fourth magnetic poles and the magnetic bar have a first polarity, and the second and fifth magnetic poles have a second polarity different from the first polarity.

34. The developing apparatus of claim 29, wherein an interval between the magnetic bar and the developing sleeve is less than 10 mm.

35. A developing apparatus in an electric photographic printer supplying a developing agent to develop an electrostatic latent image formed on a photosensitive medium, comprising:

a housing containing the developing agent and having an opening portion facing the photosensitive medium;

a developing sleeve rotatably disposed in the housing to form a developing area with the photosensitive medium and transfer the developing agent to the photosensitive medium through a developing area and the opening portion of the housing, having a first portion exposed through the opening portion of the housing and a second portion disposed in the housing;

a fixing magnet disposed in the developing sleeve and having first, second, third, fourth, fifth magnetic poles arranged in a circular direction with respect to a center of the developing sleeve, the first magnetic pole corresponding to the developing area and a starting portion of the opening portion of the housing to face the photosensitive medium, the second magnetic pole having a first section disposed adjacent to the first magnetic pole, a second section corresponding to an ending portion of the opening portion of the housing to face the photosensitive medium, and a third section disposed in the housing, the third, fourth, and fifth magnetic poles corresponding to an inside of the housing; and a magnetic bar disposed on the opening portion of the housing to form a magnetic force brush with the second magnetic pole of the fixing magnet, and having a polarity opposite to the second magnetic pole and a magnetic force equal to or less than that of the second magnetic pole of the fixing magnet.

* * * * *

UNITED STATES PATENT AND TRADEMARK OFFICE

CERTIFICATE OF CORRECTION

PATENT NO. : 6,801,732 B2
DATED : October 5, 2004
INVENTOR(S) : Jeong-jai Choi et al.

It is certified that error appears in the above-identified patent and that said Letters Patent is hereby corrected as shown below:

Column 7,
Line 34, change “comprises” to -- comprise --.

Column 8,
Line 18, change “scattering” to -- scattered --.
Line 67, after “medium” change “:” to -- ; --.

Column 9,
Line 1, change “rotatable” to -- rotatably --.
Line 11, change “scattering” to -- scattered --.
Line 18, change “is” to -- are --.

Column 10,
Line 11, insert -- and -- between “fourth” and “fifth”.

Column 11,
Line 2, insert -- and -- between “fourth” and “fifth”.

Signed and Sealed this

First Day of March, 2005

JON W. DUDAS
*Director of the United States Patent and Trademark Office*